US005624275A

United States Patent [19]

Fukuda

[11] Patent Number: 5,624,275

[45] Date of Patent: Apr. 29, 1997

[54] CONNECTOR ASSEMBLY WITH A CONNECTION DETECTING DEVICE

[75] Inventor: Masaru Fukuda, Shizuoka, Japan

[73] Assignee: Yazaki Corporation, Tokyo, Japan

[21] Appl. No.: 583,806

[22] Filed: Jan. 5, 1996

[30] Foreign Application Priority Data

Jan. 9, 1995 [JP] Japan ..... 7-001081

[51] Int. Cl.[6] ..... H01R 3/00

[52] U.S. Cl. ..... 439/489

[58] Field of Search ..... 439/489, 188, 439/187, 189

[56] References Cited

U.S. PATENT DOCUMENTS 5,464,353 11/1995 Saijo et al. ..... 439/489

FOREIGN PATENT DOCUMENTS 3-274685 12/1991 Japan ..... H01R 13/64

3-272578 12/1991 Japan ..... H01R 13/64

*Primary Examiner*—Gary F. Paumen

*Assistant Examiner*—Christopher Goins

*Attorney, Agent, or Firm*—Sughrue, Mion, Zinn, Macpeak & Seas

[57] ABSTRACT

A connector assembly including a pair of first and second connector housings with a connection detecting device. In the connector assembly, a short-circuiting contactor is set in the first connector housing, and a pair of connection detecting terminals are provided in the second connector housing. The short-circuiting contactor has two pairs of elastic pieces. In each pair, the elastic pieces are formed to be confronted with each other. When the first and second connector housings are engaged with each other, the connection detecting terminals, each being held between each pair of the elastic pieces, are electrically connected to the short-circuiting contactor.

6 Claims, 6 Drawing Sheets

CONNECTOR ASSEMBLY WITH A CONNECTION DETECTING DEVICE

BACKGROUND OF THE INVENTION

1. Field of the Invention

This invention relates to a connector assembly comprising a pair of connector housings which are, for instance, used for the connection of wire harnesses in an automobile, and which have a connection detecting device which determines whether or not the connector housings have been engaged correctly with each other.

2. Description of the Related Art

A connector assembly having a connection detecting device of this type is disclosed, for instance, in Japanese Patent Unexamined Publication No. Hei. 3-272578. The connection detecting device is generally indicated by reference character K in FIGS. 8 and 9.

The connection detecting device K comprises a pair of connection detecting contactors c provided in one connector housing a, and a short-circuiting contactor d provided in the other connector housing b.

When the two connector housings a and b are engaged incompletely or insufficiently with each other, as shown in FIG. 10, the front end portion of a flexible lock arm e of the one connector housing a is displaced downwardly, so that the short-circuiting contactor d is disconnected from the connection detecting contactor c, and accordingly, a detecting circuit does not work.

In the case where the connection of the connector housings a and b is complete, as shown in FIG. 11 the flexible lock arm e is restored, so that the short-circuiting contactor d is brought into contact with the connection detecting contactor c, and the detecting circuit works.

When the short-circuiting contactor d contactor the connection detecting contactor c, the elastic contact portion f of the connection detecting contactor c contacts the contact portion g of the short-circuiting contactor d. Hence, if the contact surfaces of them are dirty or rusty to the extent that they are not electrically conductive, the connection detecting operation is not carried out, and unexpected troubles may occur.

SUMMARY OF THE INVENTION

In view of the foregoing, an object of the invention is to provide a connector assembly comprising a pair of connector housings which have a connection detecting device which is able to detect the connection of the connector housings with high reliability, in which connection detecting terminals and a short-circuiting contactor are positively connected to each other to prevent the occurrence of troubles which are caused by the insufficient connection of the connector housings.

In order to attain the above object, the invention provides a connector assembly with a connection detecting device comprising: a first connector housing having a flexible lock arm; a second connector housing having an engaging frame in correspondence to the flexible lock arm; a short-circuiting contactor set in the first connector housing, the short-circuiting contactor having two pairs of elastic pieces which are confronted with each other for each pair; and a pair of connection detecting terminals provided in the second connector housing, wherein when the first and second connector housings are engaged with each other, the pair of connection detecting terminals, being brought into contact with the two pairs of elastic pieces respectively, are electrically connected to the short-circuiting contactor.

DETAILED DESCRIPTION OF THE PREFERRED EMBODIMENTS

Figure 1:
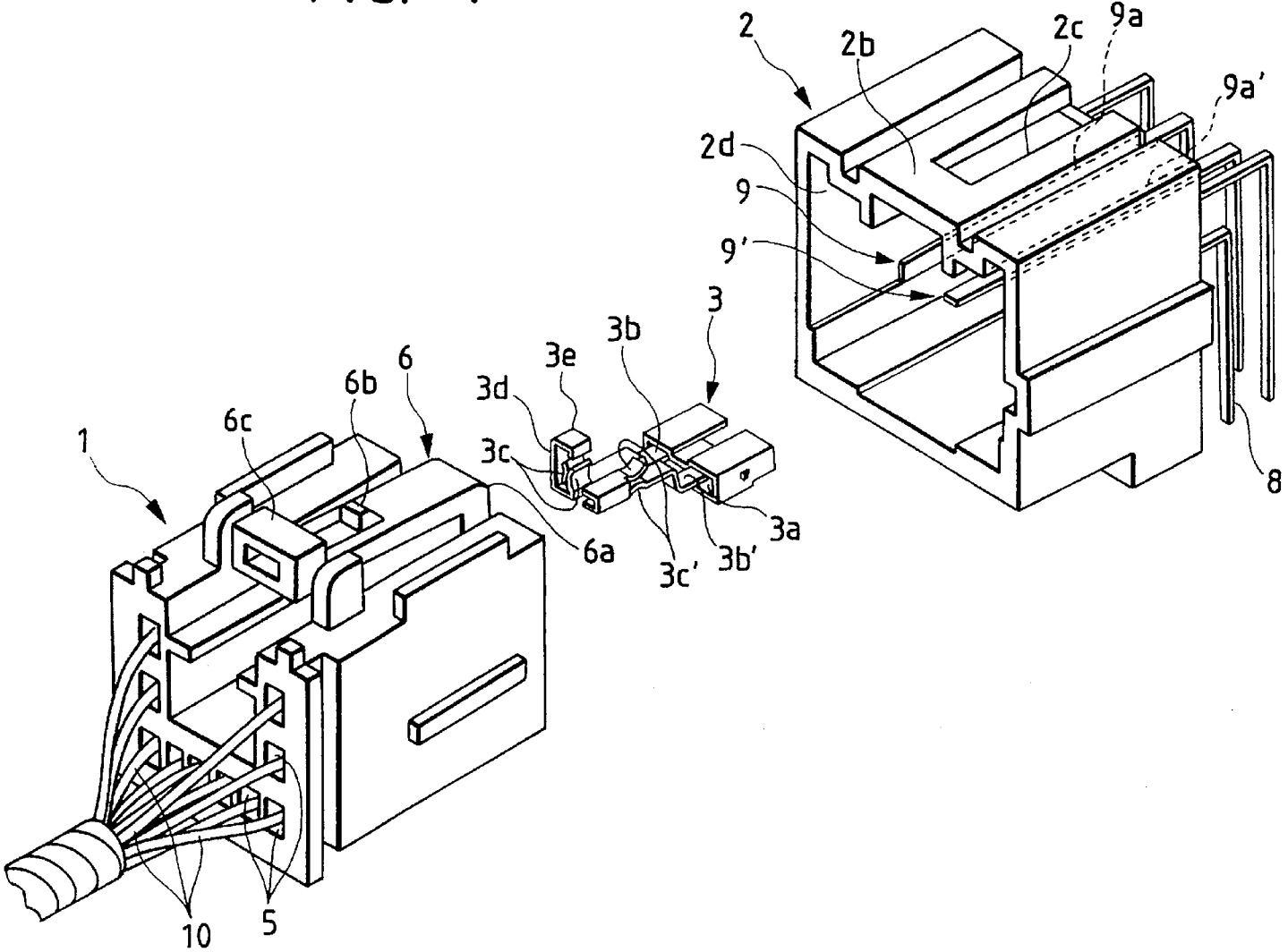
FIG. 1 is an exploded perspective view showing a connector assembly having a connection detecting device, which constitutes an embodiment of the invention.

FIG. 1 is a perspective view showing a connector assembly with a connection detecting device, which constitutes a preferred embodiment of the invention. The connector assembly comprises a first connector housing 1, a second connector housing 2 which is engaged with the first connector housing 1, and a short-circuiting contactor 3 set in the first connector housing 1.

Those connector housings 1 and 2 are formed by molding synthetic resin. More specifically, the first connector housing 1 is a male connector, while the second connector housing 2 is a female connector.

Figure 3:
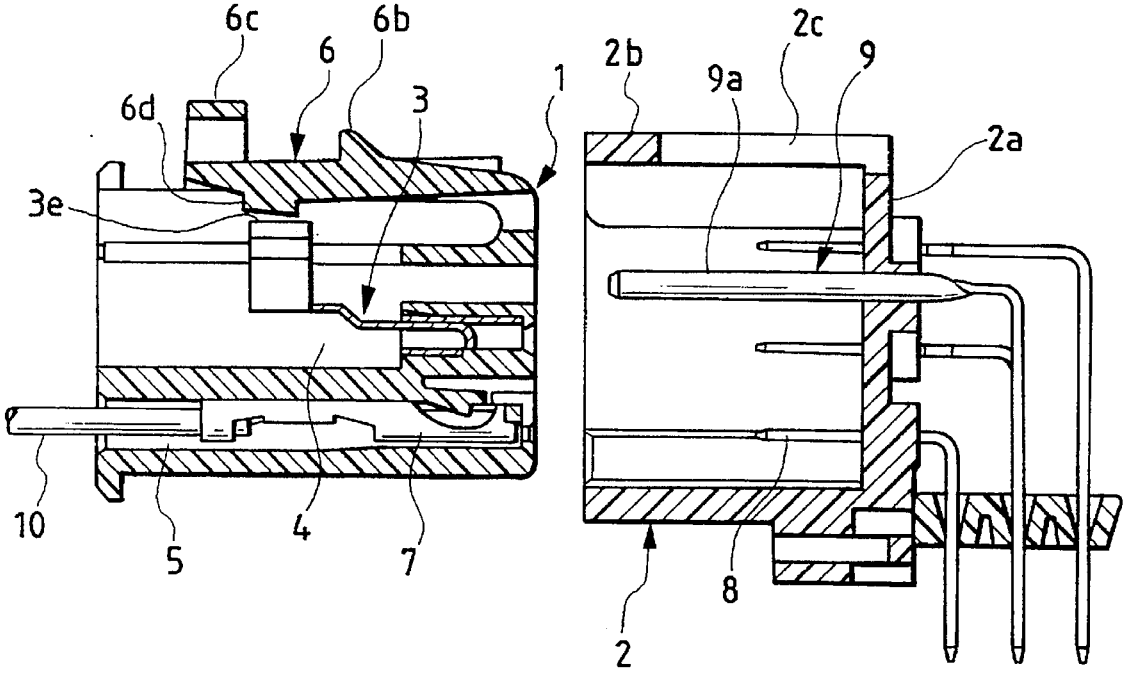
FIG. 3 is a longitudinal sectional view of a pair of connector housings, showing a position of one of the elastic contact pieces of the short-circuiting contactor.

As shown in FIG. 3, the central portion of the connector housing 1 is formed into a contactor supporting chamber 4 in which the short-circuiting contactor 3 is set. A plurality of terminal accommodating chambers 5 are formed not only below the chamber 4 but also on both sides of the chamber 4. On the upper surface of the connector housing 1, a flexible lock arm 6 is cantilevered which has a rise base portion **6*a* at the front end thereof. A locking protrusion 6*b* is formed on the flexible lock arm 6 at the middle thereof. The flexible lock arm 6 has a pressing part 6*c* at the free end thereof. That is, the short-circuiting contactor 3 is elastically displaced vertically, being pressed with the flexible lock arm 6. Female terminals 7 are accommodated in the terminal accommodating chambers 5**.

On the other hand, the second connector housing 2 has a plurality of male terminals 8 extended through its rear wall **2*a*, so that they are engaged with the female terminals 7 which are set in the terminal accommodating chambers 5 of the first connector housing 1**.

The middle of the front end portion of the upper wall of the second connector housing 2 is formed into an engaging frame 2b in correspondence to the aforementioned flexible lock arm 6, and has a locking hole 2c which is to be engaged with the locking protrusion 6b. The second connector housing 2 has a pair of connection detecting terminals 9 and 9' in addition to the male terminals 8, so that the terminals 9 and 9' are electrically connected to the short-circuiting contactor 3 when the first and second connector housings are engaged with each other. Circuits which are completed through the connection of the male and female terminals 8 and 7, are connected to external circuits through electrical wires 10 connected to the female terminals 7.

The connection detecting terminals 9 and 9' are shaped like flat plates having relatively wide contact portions 9aand 9a'. The connection detecting terminal 9 is extended inside an engaging chamber 2d of the second connector housing 2 in such a manner that the contact portion 9a is in parallel with the direction of displacement of an elastic contact piece 3b of the short-circuiting contactor 3; i.e., the direction of displacement of the elastic lock arm 6.

The other connection detecting terminal 9' is so extended that its contact portion 9a' is perpendicular to the direction of displacement of the elastic lock arm 6.

Figure 2:
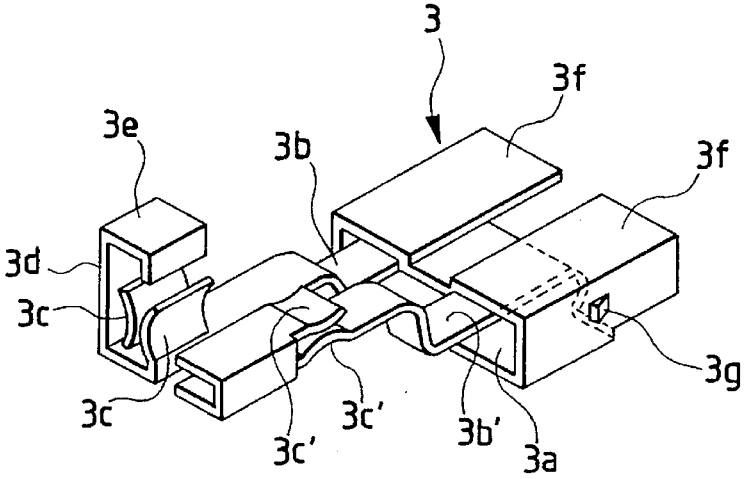
FIG. 2 is a perspective view of a short-circuiting contactor shown in FIG. 1.

As shown in FIG. 2, the short-circuiting contactor 3 is formed by bending an elastic metal plate. The contactor 3 has elastic contact pieces 3b and 3b' which are arcuately extended, in the form of a fork, from a base plate 3a; that is, those pieces 3b and 3b' are juxtaposed as cantilevered pieces. The elastic contact piece 3b has a raised piece 3d, and a pair of curved elastic pieces 3c and 3c which are confronted with each other at the free end thereof. The front end portion of the raised piece 3d is bent into a driven portion 3e which is provided for the above-described flexible lock arm 6.

The free end portion of the elastic contact piece 3b' is shaped as shown in FIG. 2. That is, the elastic contact piece 3b' is folded and curved, to form curved elastic pieces 3c' and 3c' which are located opposite to each other.

Both end portions of the base plate 3a are bent to provide cover plate portions 3f and 3f which are laid over the elastic contact pieces 3b and 3b', respectively. The cover plate portions 3f and 3f have locking protrusions 3g and 3g on their both sides, to lock the short-circuiting contactor 3 to the contactor supporting chamber 4.

Now, the function of the short-circuiting contactor 3 will be described.

Figure 4:
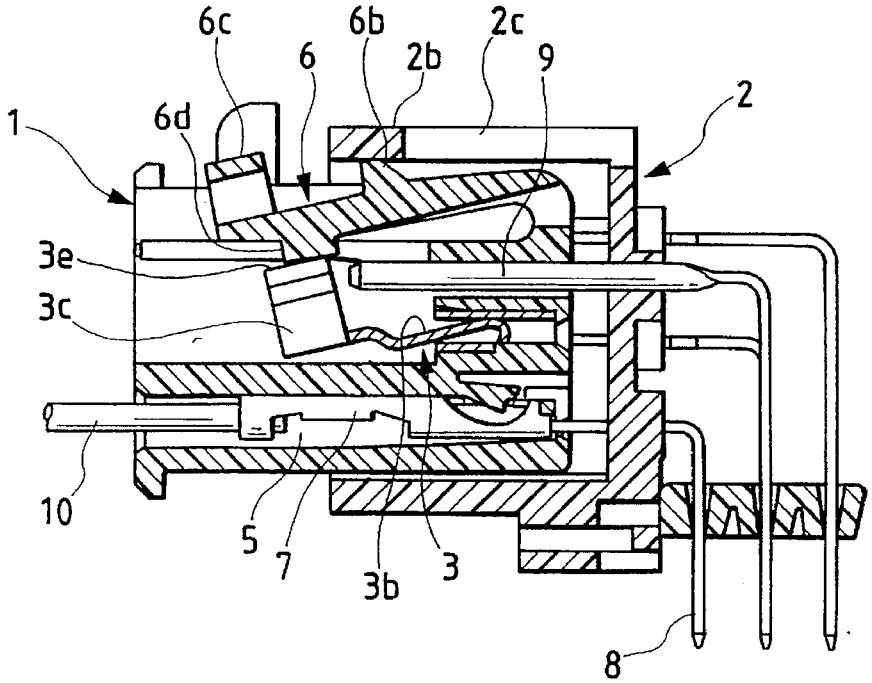
FIG. 4 is a sectional view showing the connector housings which are being engaged with each other.

When the connector housing 1 is fitted into the engaging chamber 2d of the connector housing 2, the locking protrusion 6b of the flexible lock arm 6 is abutted against the engaging frame 2b of the connector housing 2. As the connector housing 1 is further pressed into the connector housing 2, as shown in FIG. 4 the flexible lock arm 6 is moved downwardly being pressed by the engaging frame 2b of the connector housing 2.

In this operation, a pressing protrusion 6d on the lower surface of the pressing part 6c of the flexible lock arm 6 presses the driven portion 3e of the short-circuiting contactor 3, so that the elastic contact piece of the short-circuiting contactor 3 is bent downwardly, thus forming a space above the elastic piece 3c of the short-circuiting contactor 3 which is to receive the end portion of the connection detecting terminal 9.

Figure 5:
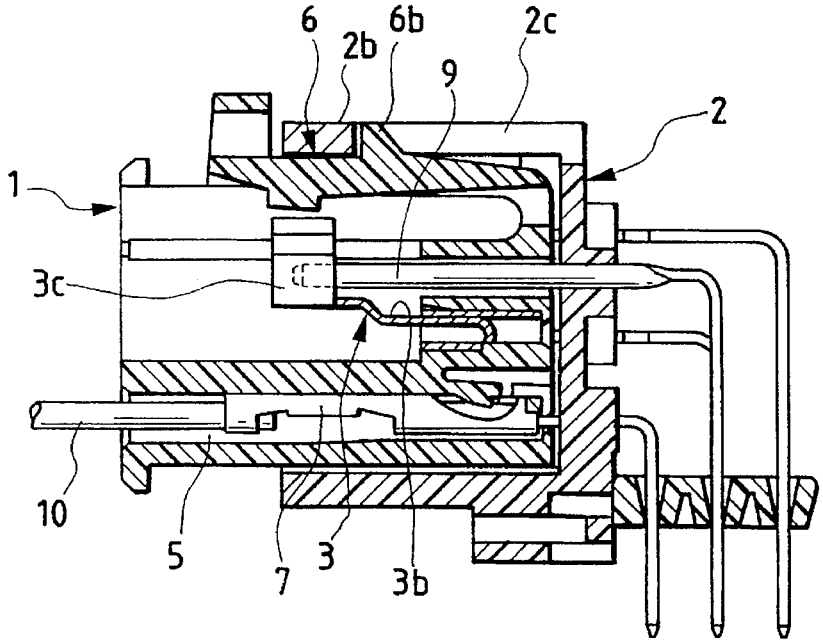
FIG. 5 is a sectional view showing the connector housings which have been engaged with each other.

As the first connector housing 1 is further moved into the second connector housing 2, as shown in FIG. 5 the locking protrusion 6b of the flexible lock arm 6 is disengaged from the engaging frame 2b of the connector housing 2, and entered into the locking hole 2c.

At this time instant, the flexible locking arm 6 is restored by its own elasticity, and accordingly, the elastic contact piece 3b of the short-circuiting contactor 3 is also returned to the original position. When the elastic contact piece 3b is returned, the connection detecting terminal 9 is located above the elastic pieces 3c and 3c of the short-circuiting contactor 3. Therefore, the connection detecting terminal 9 is inserted in between the elastic pieces 3c and 3c, so that the terminal 9 is connected to the short-circuiting contactor 3.

Figure 6:
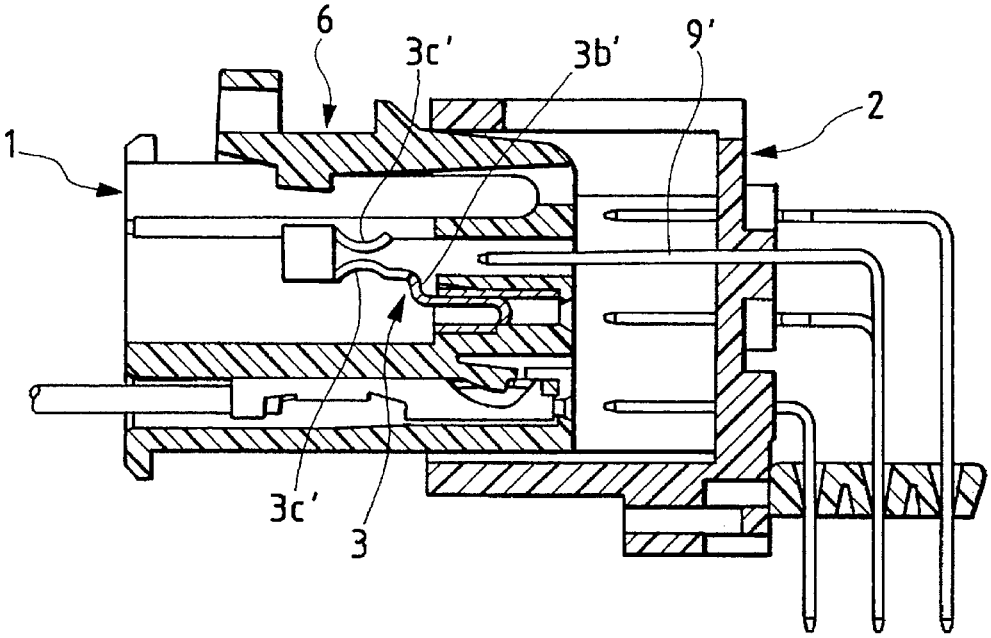
FIG. 6 is a longitudinal sectional view of the connector housings, showing a position of the other elastic contact piece of the short-circuiting contactor.
Figure 7:
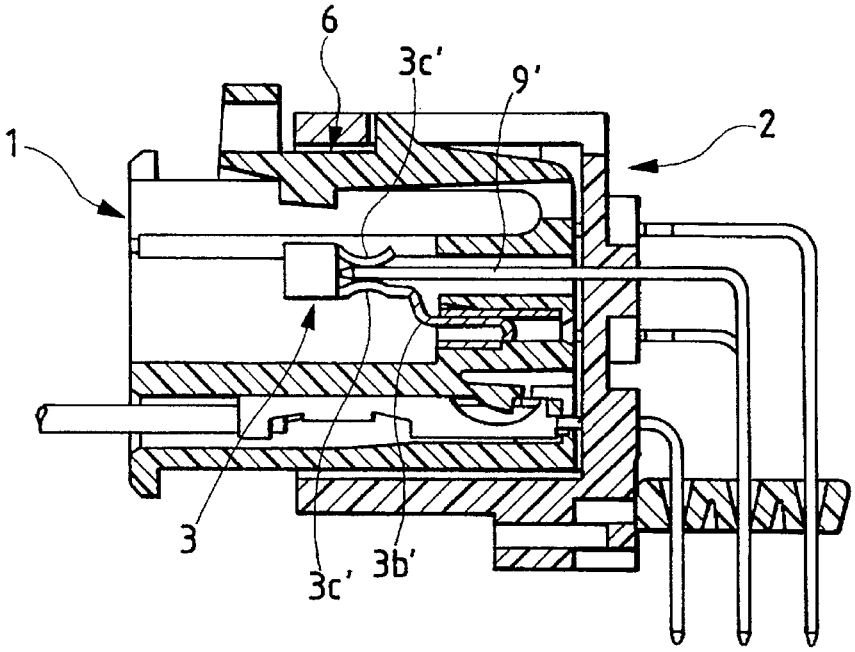
FIG. 7 is an explanatory view showing the connection of the elastic pieces of the short-circuiting contactor and the connection detecting terminal.
Figure 8:
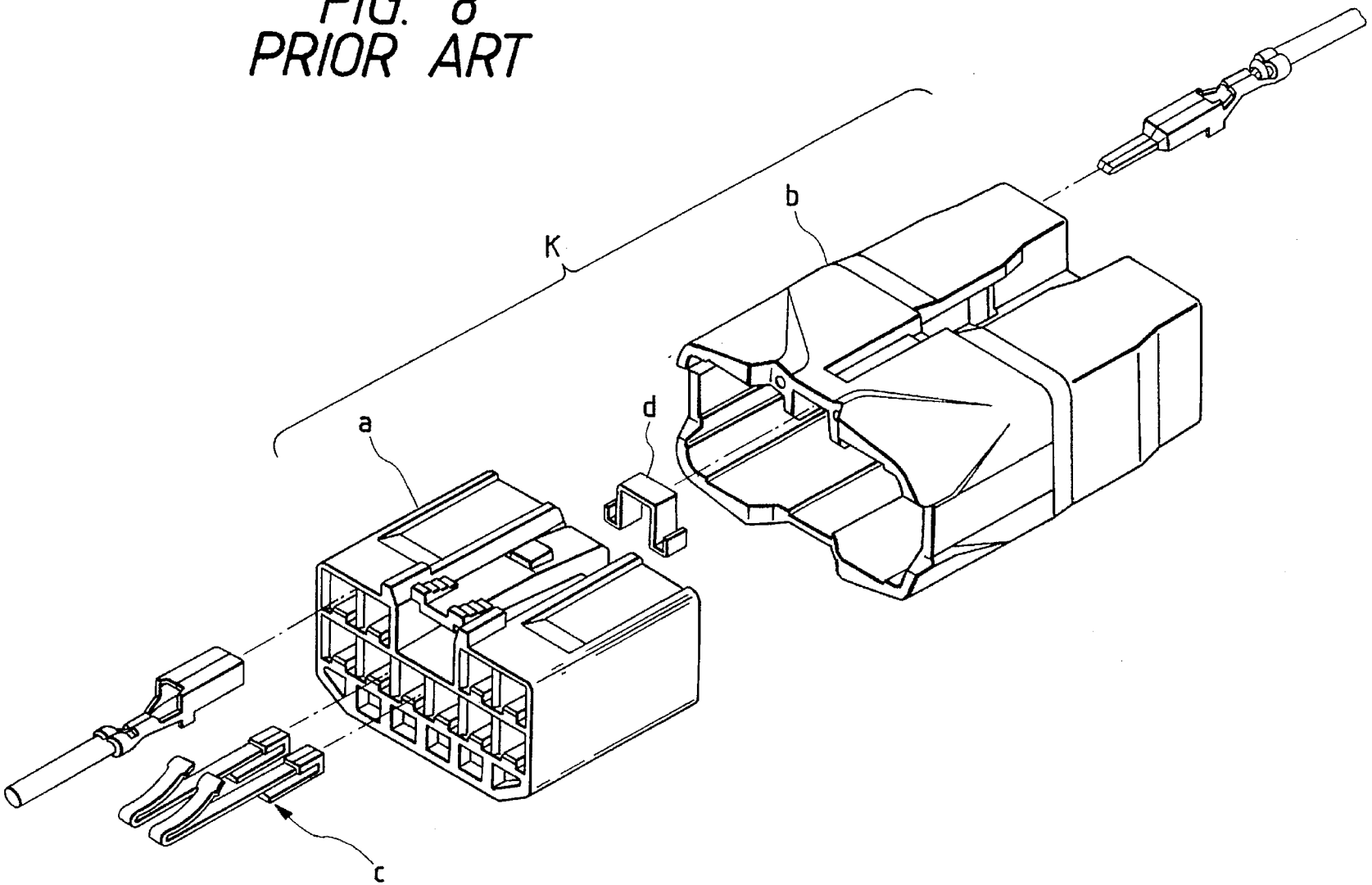
FIG. 8 PRIOR ART
FIG. 8 is an exploded perspective view of a connector assembly with a conventional connection detecting device.
Figure 9:
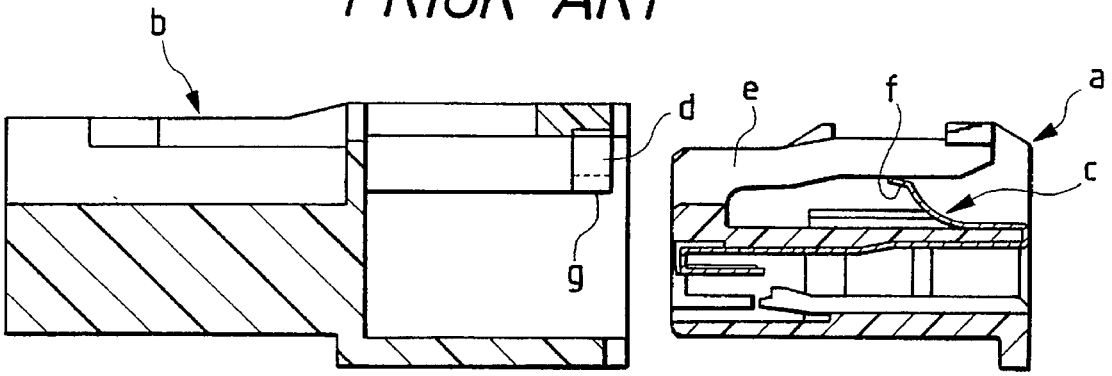
FIG. 9 PRIOR ART
FIG. 9 is a longitudinal sectional view of a pair of connector housings forming the connector assembly shown in FIG. 8.
Figure 10:
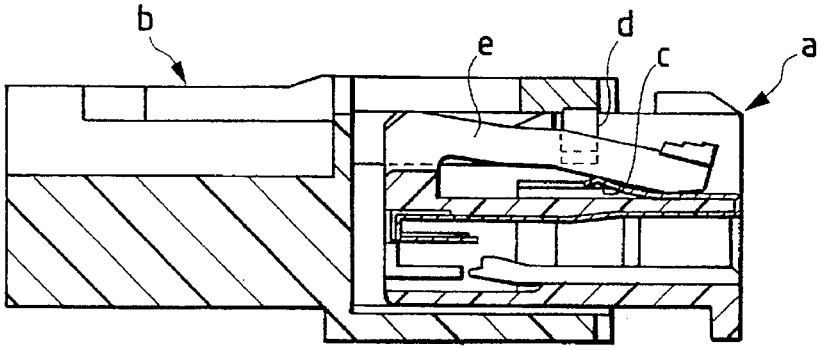
FIG. 10 PRIOR ART
FIG. 10 is a sectional view showing the connector housings which are being engaged incompletely with each other.
Figure 11:
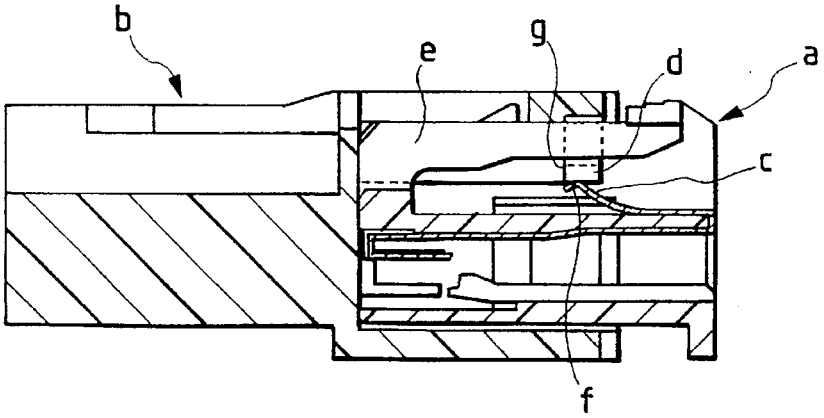
FIG. 11 PRIOR ART
FIG. 11 is a sectional view showing the connector housings which have been engaged with each other.

FIGS. 6 and 7 are explanatory views for a description of the connection of the other elastic contact piece 3b' of the short-circuiting terminal 3 and the other connection detecting terminal 9'.

When, as shown in FIG. 6, the connector housing 1 is moved into the connector housing 2, the connection detecting terminal 9' approaches the elastic pieces 3c' and 3c'. As the connector housing 1 is further moved into the connector housing 2, the terminal 9' is moved in between the elastic pieces 3c' and 3c'. When the engagement of the connector housings 1 and 2 is accomplished as shown in FIG. 7, the terminal 9' is held between the elastic pieces 3c' and 3c'.

During the engagement of the connector housings 1 and 2, as was described above, the flexible lock arm 6 is displaced. However, the elastic contact pieces 3b and 3b' of the short-circuiting contactor 3 are separated like the prongs of a fork, and therefore the elastic contact piece 3b' is scarcely affected by the depression of the flexible lock arm 6. That is, the elastic contact piece 3b' is held substantially horizontal even when the other elastic contact piece 3b is displaced. Hence, no obstruction is made to the entrance of the connection detecting terminal 9' into the space between the elastic pieces 3c' and 3c'.

In the above-described embodiment, the first and second elastic pieces 3c and 3c' of the short-circuiting contactor 3 are different in structure; however, the invention is not limited thereto or thereby. That is, each of the elastic contact pieces of the short-circuiting contactor 3 may be so designed that it has the aforementioned elastic pieces 3c and 3c, raised piece 3d, driven portion 3e at the free end thereof, and both of the connection detecting terminals may designed similarly as in the terminal 9.

In the connector assembly with the connection detecting device according to the invention, the short-circuiting contactor in one of the connector housings has the elastic pieces which are confronted with each other. As the one connector housing is engaged with the other one, the connection detecting terminal and the contact pieces are, while being slid, electrically connected to each other. Hence, even if the connection detecting terminal or elastic pieces are dirty or rusty, the dirt or rust is removed by the friction during the slide, so that the connection of the connector assembly is high in reliability. That is, the connector assembly is free from the difficulty that the short-circuiting contactor and the connection detecting terminals therein are insufficiently electrically connected to each other, and the connection is detected with high reliability at all times.

What is claimed is:

1. A connector assembly with a connection detecting device comprising:

a first connector housing having a flexible lock arm;

a second connector housing having an engaging frame in correspondence to the flexible lock arm;

a short-circuiting contactor set in said first connector housing, said short-circuiting contactor having two pairs of elastic pieces, the elastic pieces in each pair being confronted with each other; and a pair of connection detecting terminals provided in said second connector housing, wherein when said first and second connector housings are engaged with each other, said connection detecting terminals are held between one of said pairs of elastic pieces, respectively, and are electrically connected to said short-circuiting contactor.

2. The connector assembly as claimed in claim 1, wherein said short-circuiting contactor is made of an elastic metal plate, and wherein a base plate portion of said short-circuiting contactor is folded to form a pair of elastic contact pieces like a fork, and a free end portion of one of said pair of elastic contact pieces is formed into one of said two pairs of elastic pieces and a raised piece having a driven portion with respect to the flexible lock arm, while a free end portion of the other elastic contact piece is formed into the other of said two pairs of elastic pieces.

3. The connector assembly as claimed in claim 2, wherein the connection detecting terminal in correspondence to said one of said pair of elastic contact pieces has a flat contact portion extended in said second connector housing in such a manner that said contact portion is in parallel with a direction of displacement of the flexible lock arm.

4. The connector assembly as claimed in claim 3, wherein the connection detecting terminal in correspondence to said other of said pair of elastic contact pieces has a flat contact portion extended in said second connector housing in such a manner that said contact portion is perpendicular to a direction of displacement of the flexible lock arm.

5. The connector assembly as claimed in claim 1, wherein said short-circuiting contactor is made of an elastic metal plate, and wherein a base plate portion of said short-circuiting contactor is folded to form a pair of elastic contact pieces like a fork, and a free end portion of each of said pair of elastic contact pieces is formed into each of said two pairs of elastic pieces and a raised piece having a driven portion with respect to the flexible lock arm.

6. The connector assembly as claimed in claim 5, wherein each of said connection detecting terminals has a flat contact portion extended in said second connector housing in such a manner that said contact portion is in parallel with a direction of displacement of the flexible lock arm.

* * * * *